US010683151B2

(12) United States Patent
Olsen

(10) Patent No.: US 10,683,151 B2
(45) **Date of Patent: *Jun. 16, 2020**

(54) CONTAINER CARRIER

(71) Applicant: ILLINOIS TOOL WORKS INC., Glenview, IL (US)

(72) Inventor: Robert C. Olsen, Medinah, IL (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/421,757

(22) Filed: May 24, 2019

(65) Prior Publication Data

US 2019/0276211 A1 Sep. 12, 2019

Related U.S. Application Data

(63) Continuation of application No. 15/600,113, filed on May 19, 2017, now Pat. No. 10,301,092.

(60) Provisional application No. 62/412,483, filed on Oct. 25, 2016.

(51) Int. Cl.
*B65D 71/50* (2006.01)

(52) U.S. Cl.
CPC ..... *B65D 71/504* (2013.01)

(58) Field of Classification Search
CPC ..... B65D 71/50; B65D 71/504; B65D 71/00
USPC ..... 206/140–150, 162, 428, 161
See application file for complete search history.

(56) References Cited

U.S. PATENT DOCUMENTS 4,305,499 A * 12/1981 Mercer ..... B65D 71/504 206/150
4,752,011 A * 6/1988 Pudney ..... B66C 11/02 104/119
5,305,877 A * 4/1994 Olsen ..... B65D 71/504 206/150
5,474,173 A 12/1995 Hodapp
5,535,879 A 7/1996 Appleton
5,651,453 A 7/1997 Olsen
7,195,809 B2 * 3/2007 Weaver ..... B65D 71/504 206/145
7,793,778 B2 * 9/2010 Olsen ..... B65D 71/504 206/150
8,418,844 B2 * 4/2013 Slaters, Jr. ..... B65D 71/504 206/150

(Continued)

FOREIGN PATENT DOCUMENTS

EP 1 077 185 A2 2/2001

OTHER PUBLICATIONS

European Patent Office, Rijswijk, NL, Form PCT/ISA/210, "International Search Report," for Int'l Appln PCT/US2017/048807, dated Nov. 3, 2017, (5 pages).

(Continued)

*Primary Examiner* — Chun Hoi Cheung
(74) *Attorney, Agent, or Firm* — Pauley Erickson & Kottis

(57) ABSTRACT

A flexible carrier for carrying a plurality of containers within a plurality of corresponding container receiving apertures formed in longitudinal rows and transverse ranks and a handle extending parallel to the rows of container receiving apertures. The handle is connected at attachment points along the carrier and corresponding thickened sections are included along the bands opposite the connection points.

13 Claims, 2 Drawing Sheets

(56) References Cited

U.S. PATENT DOCUMENTS

| | | | | |
|---|---|---|---|---|
| 8,936,148 | B2 * | 1/2015 | Olsen | B65D 71/504 206/150 |
| 9,669,977 | B2 * | 6/2017 | Olsen | B65D 23/102 |
| 10,301,092 | B2 | 5/2019 | Olsen | |
| 2007/0181447 | A1 * | 8/2007 | Olsen | B65D 71/504 206/150 |
| 2009/0193889 | A1 * | 8/2009 | Waid | E21B 49/08 73/32 A |
| 2015/0108014 | A1 * | 4/2015 | Olsen | B65D 23/102 206/150 |

OTHER PUBLICATIONS

European Patent Office, Rijswijk, NL, Form PCT/ISA/327, "Written Opinion of the Int'l Searching Authority," for Int'l Appln PCT/US2017/048807, dated Nov. 3, 2017, (6 pages).

* cited by examiner

CONTAINER CARRIER

CROSS-REFERENCE TO RELATED APPLICATIONS

This application is a continuation of U.S. application Ser. No. 15/600,113, filed on 19 May 2017 which claims priority to U.S. Provisional Application, Ser. No. 62/412,483, filed 25 Oct. 2016. The U.S. patent application and U.S. Provisional Application are hereby incorporated by reference herein in their entirety and are made a part hereof, including but not limited to those portions which specifically appear hereinafter.

BACKGROUND OF THE INVENTION

Field of the Invention

This invention relates to a container carrier having container receiving apertures for unitizing a plurality of containers.

Description of Prior Art

Conventional container carriers are often used to unitize a plurality of similarly sized containers, such as cans, bottles, jars and boxes and/or similar containers that require unitization. Flexible plastic ring carriers are one such conventional container carrier.

Flexible plastic ring carriers having a plurality of container receiving apertures, typically of an oval, round or rectangular configuration, that each engage a corresponding container may be used to unitize groups of four, six, eight, twelve or other suitable groups of containers into a convenient multipackage. Flexible ring carriers may include a handle that extend upwardly from the carrier to enable a consumer to carry the package from the top (called a "top lift carrier") or outwardly from a side of the carrier to enable a consumer to carry the package from the side (called a "side lift carrier").

There are cost and weight benefits associated with reducing the material necessary to manufacture a carrier. However, a carrier that is reduced in material must still result in a sturdy and aesthetically pleasing package without breakage, sag at the ends or danger of container loss. Such a carrier must also withstand the rigors of high speed application to containers. As such, a need arises for a reduced-weight carrier capable of carrying a large number of containers that permits high speed application and results in an aesthetically pleasing package for the consumer to handle.

SUMMARY OF THE INVENTION

The present invention is directed to a flexible carrier for packaging containers that includes an arrangement of container receiving apertures that are configured to permit placement over containers and permit carrying a unitized package of containers along a handle extending longitudinally along the package.

The carrier is suitably configured with a combination of webs and container receiving apertures that permit opening up and generally even, distributed stretching for application to the containers. Traditional carriers typically include oval, round, rectangular or triangular shaped container receiving apertures. However, the subject invention includes container receiving apertures comprised of 15 discrete adjoining segments to maximize stretchable band width and reduce the area of material required.

Further, a series of center bands having internal center apertures further reduce weight and yet maintain contact with containers to avoid center inversions and prevent can abrasions.

In the described configuration, a flexible sheet forms webs defining container receiving apertures wherein bands at least partially define the respective container receiving apertures and a handle is positioned parallel with the rows of container receiving apertures. The resulting carrier is configured to enable placement over corresponding containers to result in a tight, unitized bricklike package.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
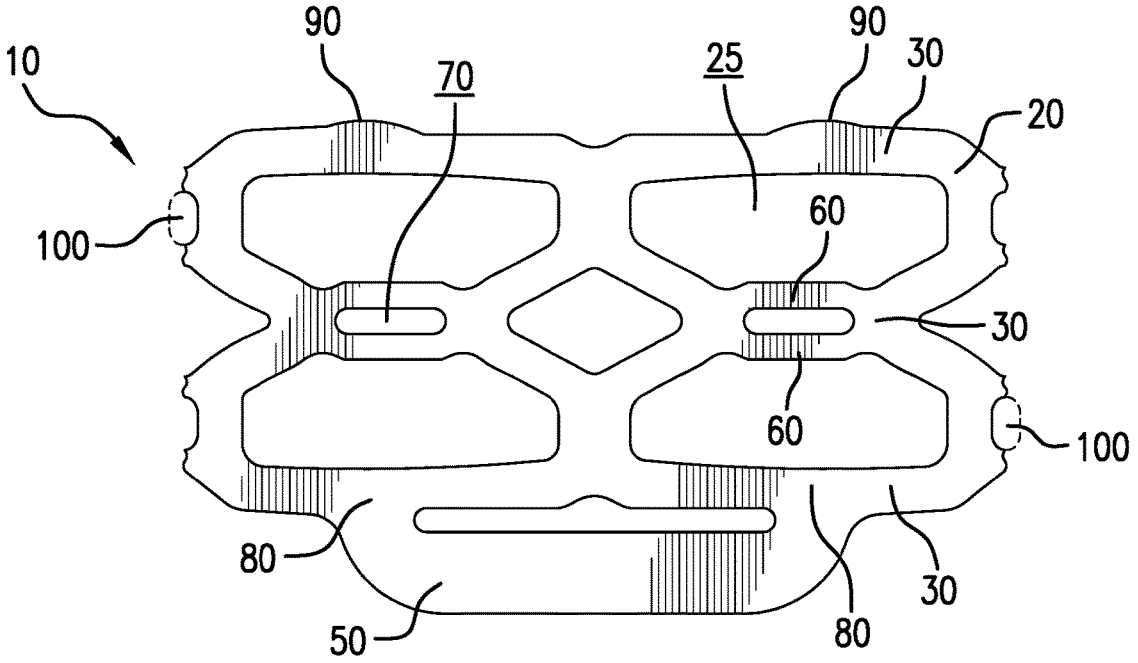
FIG. 1 is a side elevational view of a container carrier according to one preferred embodiment of this invention.
Figure 2:
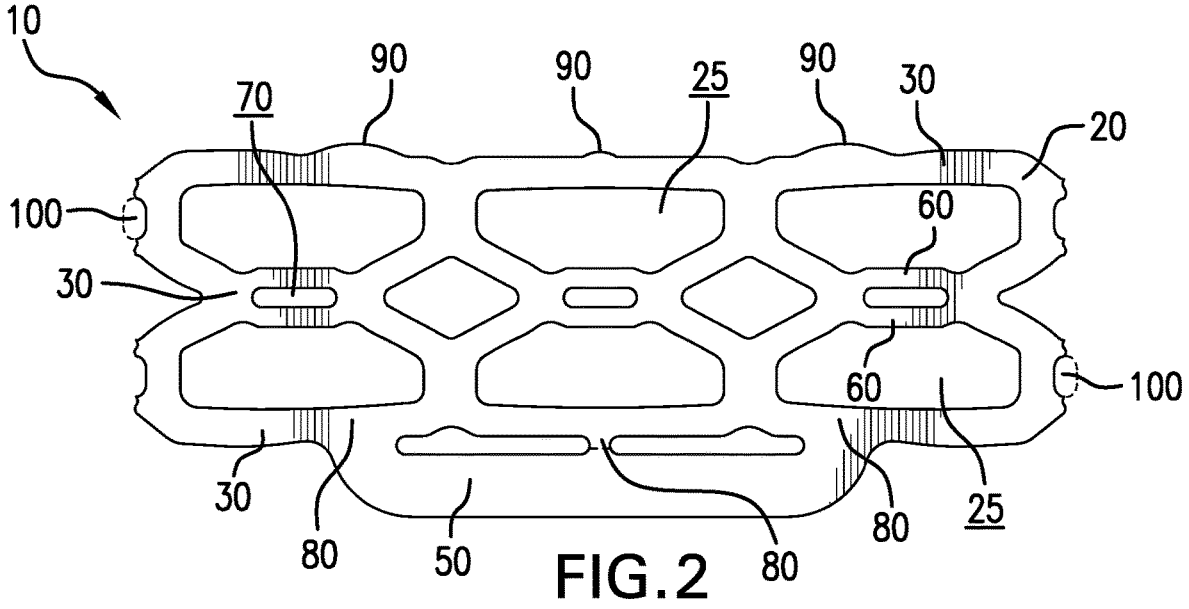
FIG. 2 is a side elevational view of a container carrier according to one preferred embodiment of this invention.
Figure 3:
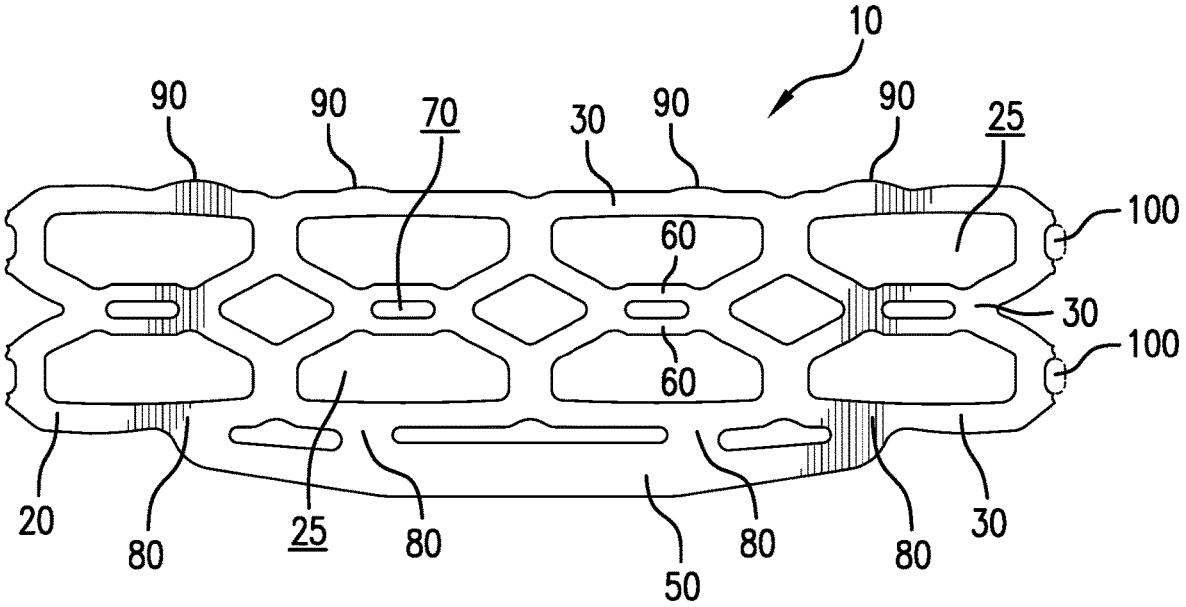
FIG. 3 is a side elevational view of a container carrier according to one preferred embodiment of this invention.

FIGS. 1-3 show flexible carrier 10 for unitizing four or more containers into a resulting unitized package. Although FIGS. 1-3 illustrate various structures for flexible carrier 10 of the invention, the illustrations are exemplary, and the invention is not limited to the flexible carriers 10 or packages shown for four, six, or eight containers. For example, flexible carrier 10 may be alternatively configured and used to unitize ten, twelve, or any other desired number of containers.

Containers are preferably cans, however, bottles or any other commonly unitized container may be used with flexible carrier 10 according to this invention. The containers are preferably, though not necessarily, like-sized within a single flexible carrier 10.

Each flexible carrier 10 preferably includes a single layer of flexible sheet 20 having a width and length defining therein a plurality of container receiving apertures 25, each for receiving a container. The plurality of container receiving apertures 25 are preferably arranged in two longitudinal rows and multiple longitudinal ranks so as to form an array of container receiving apertures 25, such as two rows by two ranks for a four container multipackage as shown in FIG. 1 or two rows by three ranks for a six container multipackage as shown in FIG. 2 or two rows by four ranks for an eight container multipackage as shown in FIG. 3. Container receiving apertures 25 are preferably generally elongated in a longitudinal direction of flexible carrier 10.

Traditional carriers developed for cans and bottles, grip a circumference or body of the respective container with flexible bands forming a container receiving aperture. The flexible carrier 10 of the subject invention aims to reduce area and thereby weight to minimize material and resulting waste and still maximize firm engagement with the containers. Reduction of the flexible carrier 10 area not only reduces the overall weight, but also is accomplished in such a way that it also allows the carrier to stretch out more efficiently without depending on any additional material additive, such as metallocene, to the flexible sheet material 20, which is preferably formed of a low density polyethylene.

A representative package resulting from flexible carrier 10 includes a plurality of unitized containers. Flexible carriers 10 are generally applied to containers by stretching flexible sheet 20 surrounding container receiving apertures 25 around container, and requiring the stretched carrier 10 to recover, thereby providing a tight engagement.

A preferred carrier configuration includes two distinct parallel rows of container receiving apertures 25. Each rank preferably includes two container receiving apertures 25 (one for each row in the carrier 10). Preferably, each of the carriers 10 shown in FIGS. 1-3 are manufactured in a generally continuous string of carriers 10 wherein carriers 10 are punched or otherwise formed longitudinally adjacent to other carriers 10. In this manner, a generally continuous string of carriers 10 is formed that may be rolled onto reels or folded into boxes for later unwinding and application to containers. The carriers are then cut into individual carriers 10 and packages. As partially shown in FIGS. 1-3, a pair of oval separation apertures 100 are positioned between each adjacent container carrier 10 in the generally continuous string of container carriers. Such a configuration particularly assists with the folding ("fan-folding") of the string of carriers 10 into cartons.

As shown in FIGS. 1-3, two parallel rows of container receiving apertures 25 are preferably formed within flexible sheet 20. As such, one row of container receiving apertures 25 is preferably formed along each side of the carrier 10. As shown, it is preferable that each container receiving aperture 25 in a single row is configured identically with the others. As shown, this means that each container receiving aperture 25 in a top row is identical and each container receiving aperture 25 in a bottom row is identical, and within each rank, the container receiving apertures 25 are preferably mirror images of each other.

Container receiving apertures 25 are preferably formed in a geometry that results in a uniform application of the carrier 10 to containers to produce a tight unitization of containers within flexible carrier 10. Such a result is difficult when material within the flexible carrier 10 is minimized as shown and described herein.

As described above, container carrier 10 according to a preferred embodiment of the invention includes a series of interconnecting flexible bands 30 that define the plurality of container receiving apertures 25. Bands 30 are stretchable around respective containers during application and recoverable around container following application. Specifically, in the described configuration, the flexible sheet 20 forms bands 30 defining container receiving apertures 25 wherein the bands 30 in an interior of the carrier 10 include outer edges that are not strictly parallel with each other.

As shown in FIGS. 1-3, a handle 50 extends from a longitudinal edge of carrier 10. The handle 50 may comprise one or more elongated apertures positioned along the outer periphery of the handle 50 or may comprise a similar configuration that provides an ample area for a consumer to grasp by inserting a hand through and still maintain the purpose and integrity of package.

As shown in FIGS. 1-3, the handle 50 is connected to the flexible bands at two or more connection points 80. A thickened section 90 is located along each flexible band 30 located on a direct opposite side from a respective connection point 80 within each transverse rank. Each thickened section 90 preferably extends outwardly from an outside edge of a respective band 30. As such, each pair of container receiving apertures 25 within a rank includes a corresponding connection point 80 along one edge and a corresponding thickened section 90 along an opposite edge of the carrier 10. Specifically, as shown in FIG. 1, the flexible carrier 10 includes two connection points 80 and two thickened section 90. FIG. 2 shows the flexible container carrier 10 including three connection points 80 and three corresponding thickened sections 90. As shown in FIG. 3, the flexible carrier 10 includes four connection points 80 and four corresponding thickened sections 90.

The addition of the connection points 80 and the corresponding thickened sections 90 enable the carrier 10 to function as if it is symmetrical when being stretched on the applicator. In that manner, the stresses on both outer bands 30 of the carrier 10 elongate similarly. As such, the carrier 10 can be fed onto the applicator with the handle 50 located on either side without fear of having high stress areas which may overstretch or neck down prematurely.

The flexible container carrier 10 preferably further comprises a center aperture 70 positioned within a center band 30 between each container carrier 25 in a respective rank. Although the center aperture 70 may comprise other desired shapes, as shown in FIGS. 1-3, the center aperture 70 comprises an elongated oval. According to preferred embodiments, the center aperture 70 includes a width approximately equal to a width of flaps 60 of material on each side of the center aperture 70.

The flexible container carrier 10 therefore includes flaps 60 of material extending into each container receiving aperture 25 from the center aperture 70. Preferably, each such flap 60 extends into a container receiving aperture 25 from an inner portion of each container receiving aperture 25. These flaps 60 form a desirable configuration in a center band 30 of the carrier following application to containers and preferably prevent inversions in that web which would jeopardize a sturdy package and the aesthetics of the package.

In embodiments of the invention, weight reduction is accomplished by taking material out of the central regions of the carrier 10, which upon normal stretching, is usually under little or no stress. The effective band width which undergoes stretching is also increased as compared to similar products. As much as 77% of the bands periphery adjacent to the aperture is stretched to some degree, as compared to about 70% on a similar design without using this concept. This makes this carrier design less apt to overstretch in critical areas.

The resulting aperture shape is also quite different than on prior designs, with 15 distinct adjoining segments. This is required in order to maximize the effective band width (stretchable) used as well as to reduce the area.

A width of the center band is also reduced to a minimum with the addition of the center aperture 70 which takes out unused material. This is possible since the center bands 30 function is to separate the containers in the transverse direction and thus provide a thin buffer zone which helps keep the containers from rubbing against one another laterally. Even in its reduced state, the subject configuration still accomplishes this. The center aperture 70 and resulting flaps 60 also reduce the chance for center web inversions and helps prevent can abrasion.

Another center band function is to help hold onto the containers so they do not pull out when lifted by one container only. By dividing the center bands into two segments or flaps 60, the carrier 10 more firmly holds to the container being lifted since it is free to move with the container.

Generally speaking, container multipack carriers have been designed using conventional aperture shapes (oval, round, rectangular, triangular) and sizes. This design breaks that rule in order to provide the most area to allow stretching. It also allows there to be minimal area or weight in order to conserve material.

While in the foregoing specification this invention has been described in relation to certain preferred embodiments thereof, and many details have been set forth for purpose of illustration, it will be apparent to those skilled in the art that flexible carrier 10 and package 100 susceptible to additional embodiments and that certain of the details described herein can be varied considerably without departing from the basic principles of the invention.

The invention claimed is:

1. A flexible container carrier for unitizing a plurality of containers comprising:

a plurality of flexible bands that form an array of container receiving apertures, the array arranged in longitudinal rows and transverse ranks;

a single handle formed adjacent the array of container receiving apertures, the handle connected to the flexible bands at two or more connection points; and two or more thickened sections of an outside edge of each outermost flexible band, each thickened section extending outwardly from an outside edge of a respective band located on a direct opposite side from a respective connection point within each transverse rank.

2. The flexible container carrier of claim 1 further comprising:

a center aperture positioned within a center band between each container receiving aperture in a respective rank.

3. The flexible container carrier of claim 2 wherein the center aperture comprises an elongated oval.

4. The flexible container carrier of claim 1 further comprising:

wherein the center aperture includes a width approximately equal to a width of center webs of material on each side of the center aperture.

5. The flexible container carrier of claim 1 further comprising a flap of material extending into each container receiving aperture from the center aperture.

6. The flexible container carrier of claim 1 comprising three connection points and three corresponding thickened sections.

7. The flexible container carrier of claim 1 comprising adjacent container carriers formed on each longitudinal side of the flexible container carrier to form a generally continuous string of container carriers.

8. The flexible container carrier of claim 1 further comprising a pair of oval apertures positioned between each adjacent container carrier in the generally continuous string of container carriers.

9. A flexible container carrier for unitizing a plurality of containers comprising:

a plurality of flexible bands that form an array of container receiving apertures, the array arranged in longitudinal rows and transverse ranks;

a handle formed adjacent the array of container receiving apertures, the handle connected to the flexible bands at three connection points;

two or more thickened sections of each outermost flexible band, each thickened section extending outwardly from an outside edge of a respective band located on a direct opposite side from a respective connection point within each transverse rank;

a center aperture positioned within a center band between each container receiving aperture in a respective rank.

10. The flexible container carrier of claim 9 wherein the center aperture comprises an elongated oval.

11. The flexible container carrier of claim 9 further comprising a flap of material extending into each container receiving aperture from the center aperture.

12. The flexible container carrier of claim 9 comprising adjacent container carriers formed on each longitudinal side of the flexible container carrier to form a generally continuous string of container carriers.

13. The flexible container carrier of claim 9 wherein the container receiving apertures each comprise a plurality of distinct adjoining segments.

* * * * *